US012000127B2

(12) United States Patent
Sapp et al.

(10) Patent No.: US 12,000,127 B2
(45) Date of Patent: Jun. 4, 2024

(54) LIFT ROD POP-UP DRAIN ASSEMBLY

(71) Applicant: COMPASS MANUFACTURING INTERNATIONAL, LLC, Louisville, KY (US)

(72) Inventors: Ken Sapp, Lakeville, MN (US); DeChang Li, Maspeth, NY (US)

(73) Assignee: COMPASS MANUFACTURING INTERNATIONAL, LLC, Louisville, KY (US)

( * ) Notice: Subject to any disclaimer, the term of this patent is extended or adjusted under 35 U.S.C. 154(b) by 0 days.

(21) Appl. No.: 17/868,749

(22) Filed: Jul. 19, 2022

(65) Prior Publication Data

US 2023/0146089 A1 May 11, 2023

Related U.S. Application Data

(60) Provisional application No. 63/223,357, filed on Jul. 19, 2021.

(51) Int. Cl.
*E03C 1/23* (2006.01)

(52) U.S. Cl.
CPC ..... *E03C 1/2302* (2013.01)

(58) Field of Classification Search
CPC ..... E03C 1/2302; E03C 1/23
USPC ..... 4/689–693, 684–685
See application file for complete search history.

(56) References Cited

U.S. PATENT DOCUMENTS 9,945,105 B2 * 4/2018 Ye et al. ..... E03C 1/2302
2018/0171610 A1 * 6/2018 Ahuja ..... E03C 1/2302

FOREIGN PATENT DOCUMENTS

CN 105757374 B 7/2016
CN 205577037 U 9/2016
CN 105736871 A 4/2018

* cited by examiner

*Primary Examiner* — Tuan N Nguyen
(74) *Attorney, Agent, or Firm* — Carrithers Law Office, PLLC

(57) ABSTRACT

The invention describes a quick install lift rod pop-up sink drain assembly comprising a drain body, a drain plug, a horizontal pivot rod used as a lever for raising and lowering the drain plug, a lock ring which rotatably secures the horizontal pivot rod to the drain body, and a lift rod rotatably connected to the outer free end of the horizontal pivot rod and used to raise or lower the free end of the horizontal pivot rod. A spherical portion of the horizontal pivot rod is rotatably captured inside a free end of a connector which is integral with the drain body and which contains pawls which capture the spherical portion of the rod and allow up and down movement of the rod with respect to the drain body, causing the drain plug to open and close.

20 Claims, 11 Drawing Sheets

LIFT ROD POP-UP DRAIN ASSEMBLY

CROSS REFERENCE TO RELATED APPLICATIONS

This application claims priority from U.S. Provisional Application Ser. No. 63/223,357 filed on Jul. 19, 2021, which is incorporated by reference herein in its entirety.

TECHNICAL FIELD

The present invention relates to the field including sink drains with plugs and plug control assemblies.

BACKGROUND OF THE INVENTION

Currently, bathroom sinks are provided with a pup up drain plug which is operated by a lift rod rotatably connected to a horizontal pivot rod which is also rotatably connected to the drain body whereby a spherical ball is integral to the horizontal pivot rod and is rotatably captured within the drain body. The sphere is rotatably captured by a threaded retaining nut which is hand threaded and tightened over the sphere and onto the drain body to provide a fulcrum point for the lift rod which is connected at the opposite end from the lift rod, to the bottom of the drain plug and acts as a lever to raise or lower the drain plug. Attaching the horizontal lever in this way is quite effective in that the retaining nut can be hand tightened to provide a leak proof connection and the lift rod can be easily raised or lowered to operate the drain plug. However, the act of assembling these parts is cumbersome and time consuming. Further, aligning the end of the horizontal pivot rod with the hole in the bottom end of the drain plug is sometimes difficult. The connecting and disconnecting of the aforementioned parts is done on initial installation, whenever the drain or pipes are clogged, whenever something is lost down the drain, or when a time might come to replace the drain. In any of these events, an improved system to allow for faster and easier assembly is needed.

DESCRIPTION OF THE RELATED ART

The closest related art appears to be China Patent No. CN105757374B which was published on Sep. 14, 2016 and teaches a drain with a pop-up drain plug including a quick attach assembly rotatably connecting the pop-up lever to the drain body which is incorporated by reference herein. China Patent 105736871 which was published on Apr. 20, 2018 teaches a sink plunger lift rod assembly. China Patent 105757374B was published on Jul. 13, 2016 and teaches a ball and valve assembly for a sink having a socket ball locking means.

Conventional pop-up drain assemblies typically use a threaded retaining nut which threadably engages a threaded tee stem projecting from the drain conduit body. The retaining nut adjustably holds and compresses a ball extending near a distal end of the pivot rod which is raised and lowered with a lift rod having a top portion connecting to a pull via a clevis and which extends above a sink. The lift rod is usually connected to the pivot rod by sliding the pivot rod through a selected hole in the lift rod whereby the pivot rod is secured in position by a spring clip.

Plumbers spend considerable time assembling the apparatus for each sink. Moreover, the distal end of the pivot rod is disposed through the connector tee stem and is positioned within the pop-up assembly conduit for engaging the drain plunger. The use of a threaded retaining nut and spring clips lack precision and require adjustment during installation.

There is a need for a quick installation device with insures proper placement with guides and stops for proper alignment and spacing and can be retained with a quick 180 degree turn of a retaining wing nut.

SUMMARY OF THE INVENTION

The invention describes a quick install lift rod pop-up sink drain assembly comprising a drain body, a drain plug, a horizontal pivot rod used as a lever for raising and lowering the drain plug, a lock ring which rotatably secures the horizontal pivot rod to the drain body, and a lift rod rotatably connected to the outer free end of the horizontal pivot rod and used to raise or lower the free end of the horizontal pivot rod. A spherical portion of the horizontal pivot rod is rotatably captured inside a free end of a connector which is integral with the drain body and which contains pawls which capture the spherical portion of the rod and allow up and down movement of the rod with respect to the drain body, causing the drain plug to open and close. In addition, stops and guides are used to quickly align the lift rod and pivot rod and for insertion of the ball in the correct position quickly and accurately.

In accordance with the present invention, there is provided a pop-up drain assembly comprising or consisting of a drain body, a drain plug, a horizontal pivot rod, a lock ring, and a lift rod rotatably connected to the outer free end of the horizontal pivot rod; the drain body being mostly cylindrical and comprising a lower unthreaded section, an upper threaded section and a middle unthreaded section with a connector drain tee stem extending outward perpendicularly from the middle section. The drain tee stem includes a smooth section terminated by a castellated section containing at least two pawls, each of the pawls including a radially outward protruding step and an inward facing ramped step. The horizontal pivot rod includes an integral spherical ball located about two inches from the first end. The drain plug has an aperture formed at the bottom end. The drain plug is inserted downward into the drain body. The aperture in the drain plug end is aligned with the drain tee connector stem. The first end of the horizontal pivot rod is pushed through the castellated section of the drain tee connector stem. The ball of the horizontal pivot rod is pushed through the pawls and snapped into the drain tee connector stem. The drain tee connector stem has an inner square annular void formed therein. The annular void is capable of receiving a flat ring seal, the curvature of the inward facing ramped steps matches the curvature of the ball. The drain tee connector stem has inner vertical guide walls and the horizontal pivot rod has square vertical shoulders cooperatively and slidably engaging the vertical guide walls. The lock ring comprises a hollow cylinder with two wings extending radially outward from outer walls of the lock ring and two downward extending lugs integral to bases of the two wings. The lugs cooperatively press against the drain body when the lock ring is tightened. The lock ring has an inner diameter equal to the outer diameter of a circle formed by the outer walls of the at least two pawls. The lock ring has a cylindrical void formed in the outer end for receiving the pawl steps extending radially outward from the free edges of the at least two pawls. The drain body has two stop lugs extending radially outward therefrom providing a positive stop to locate the lock ring in a position which causes the pawls to apply holding pressure against the ball. The drain plug comprises a cap, a longitudinal body with four longitudinal walls, which are perpendicular to one another, and a downward extending drain plug lug having an aperture in the bottom end. The first end of the horizontal pivot rod is inserted into the drain tee connector stem and then inserted into the aperture of the plug lug. The four longitudinal perpendicular walls together form a 'X' or a cross. The drain body has an integral arcuate lug extending radially inward and cooperatively engaging the cross, providing a guide to help insure that the drain plug is positioned properly in the drain body.

It is an object of this invention to provide a quick install lift rod type pop-up sink drain with a pop-up drain plug which can be assembled faster than the pop-up drain plug assemblies commonly used in the art.

It is an object of this invention to provide a sink drain with a pop-up drain plug which provides easy alignment of the hole at the bottom end of the plug with the end of the horizontal pivot rod which operates the plug, that alignment being provided by an arcuate plug alignment lug extending inwardly from an inside wall of the drain body.

It is an object of this invention to provide a sink drain with a pop-up drain plug which allows the spherical ball integral with the horizontal pivot rod to be rotatably snapped into a receiver which is integral with the body of the drain.

It is an object of this invention to provide a sink drain with a pop-up drain plug including a manual locking ring which causes the receiver to hold fast to the spherical ball.

It is an object of this invention to provide a sink drain with a pop-up drain plug including a flat ring held between the drain body and the spherical ball and wherein the inner edge contacting the ball is cambered, thus providing an enlarged sealing surface to provide a leak-proof connection.

It is an object of this invention to provide a sink drain with a pop-up drain plug wherein the drain body includes at least one outward extending lug which acts as a positive stop and a mark for registering the manual locking ring with the drain body in the position that provides for maximum locking force between the receiver and the spherical ball.

It is an object of the present invention to provide a smooth ball surface to smother operating movements and for rotation 90 degrees using an enlarge metal insert to improve the strength of the ball rod minimizing flexing of the ball rod associated with conventional ball rods consisting of plastic.

It is an object of the present invention to provide improved O-ring design to the bowl type seal washer to provide better sealing capability and reduce the compression of the rubber sealer.

It is an object of the present invention to provide two spaced apart rotation stoppers.

It is an object of the present invention to provide ball rod installation optimization whereby the rotary rod direction guide design makes the ball rod go into the pop-up body easily with minimal alignment.

It is an object of the present invention to provide a secured restrictor which aids in alignment.

It is an object of the present invention to utilize a bowl type seal washer to provide better sealing capacity and reduce the compression of the rubber seal.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
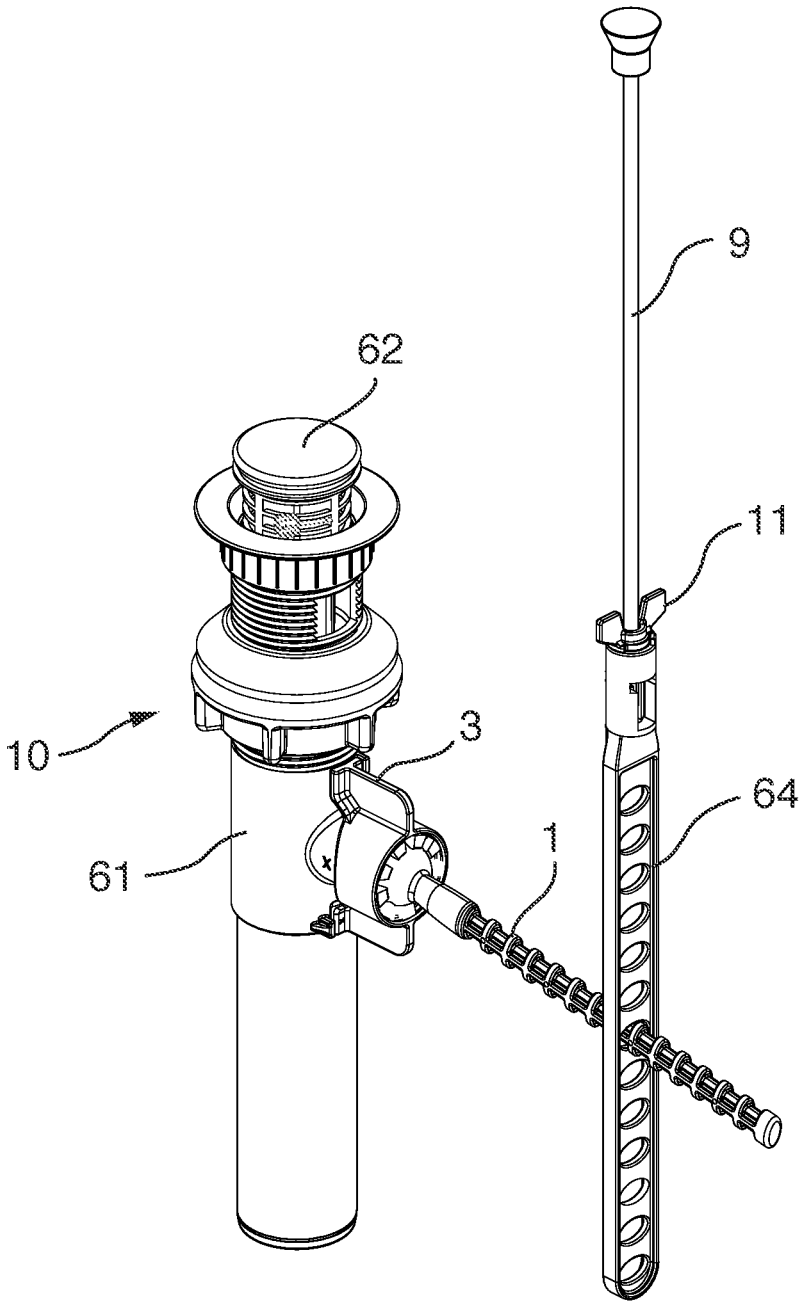
FIG. 1 is a perspective view of a pop-up drain assembly including the drain body with the drain plug, the horizontal pivot rod and the lift rod for a lift rod pop-up assembly.
Figure 2:
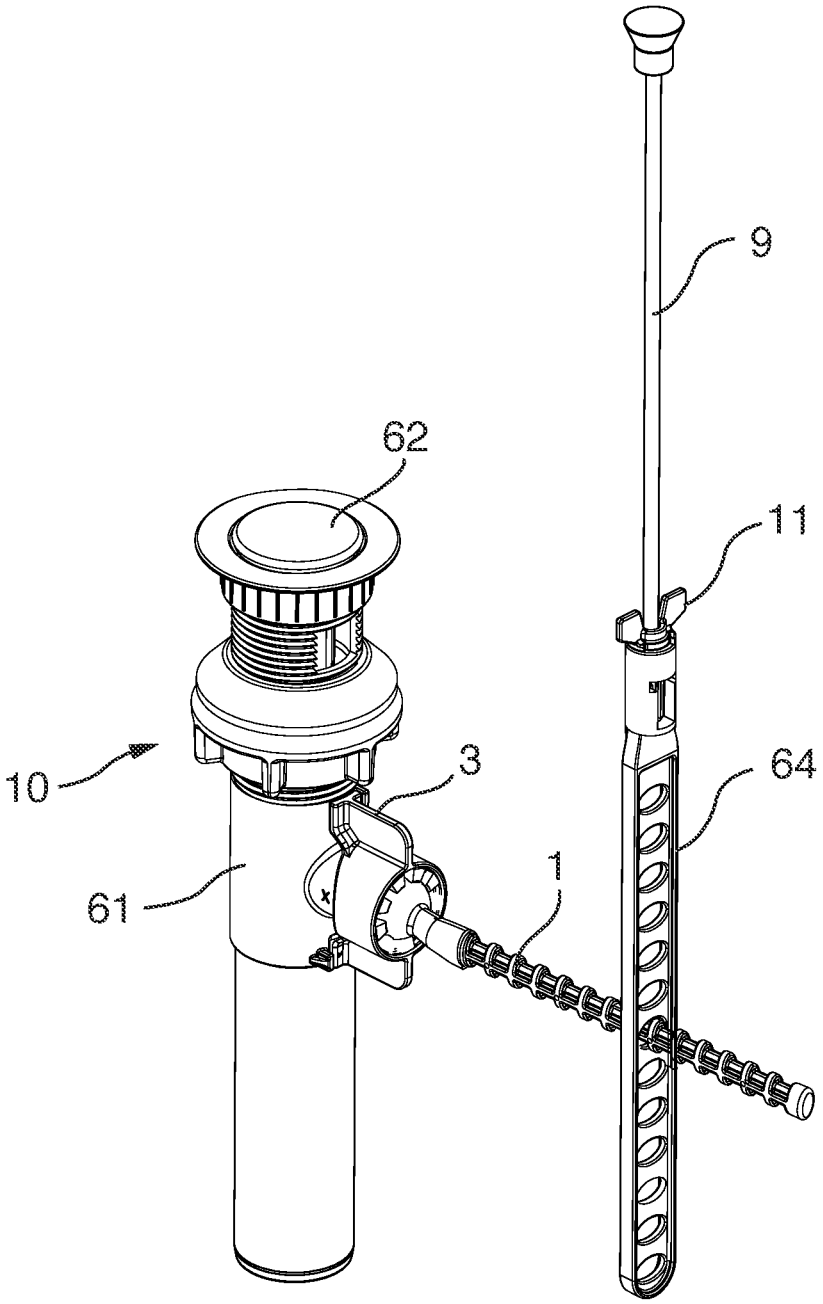
FIG. 2 is a perspective view of the improved pop-up drain assembly of the present invention including the drain body with the drain plug, the horizontal pivot rod and the lift rod for a lift rod pop-up assembly.
Figure 3:
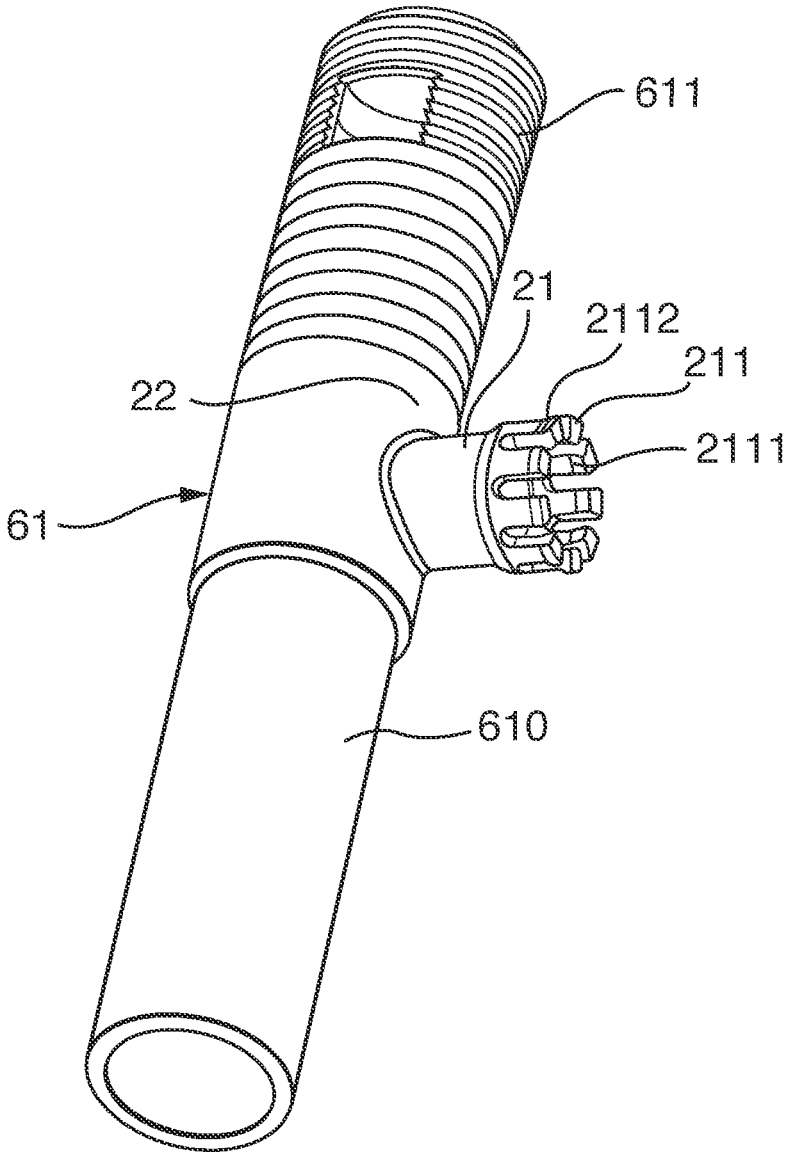
FIG. 3 is a front right perspective view of the drain body.

In accordance with the present invention, there is provided a sink pop-up drain assembly generally used for a bathroom sink, comprising a drain body, a drain plug, a horizontal pivot rod used as a lever for raising and lowering the drain plug, a lock ring which rotatably secures the horizontal pivot rod to the drain body, and a lift rod rotatably connected to the outer free end of the horizontal pivot rod and used to raise or lower the free end of the horizontal pivot rod. A spherical portion of the horizontal pivot rod is rotatably captured inside a free end of a connector which is integral with the drain body and which contains pawls which capture the spherical portion of the rod and allow up and down movement of the rod with respect to the drain body, causing the drain plug to open and close.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Example embodiments will now be described more fully with reference to the accompanying drawings.

In accordance with the present invention, there is provided a pop-up drain assembly 10, generally used for a bathroom sink, comprising a drain body 61, a drain plug 62, a horizontal pivot rod 1 used as a lever for raising and lowering the drain plug 62, a lock ring 3 which rotatably secures the horizontal pivot rod to the drain body, and a lift rod 64 having a lift rod stem 9 removably held in position by a rotational lock mechanism 11, rotatably connected to the outer free end of the horizontal pivot rod 1 and used to raise or lower the free end of the horizontal pivot rod 1.

As shown in the FIGS. 1-24, the mostly cylindrical drain conduit body 61 includes a lower unthreaded section 610, an upper threaded section 611 and a middle unthreaded section 22 with an integral drain tee connector stem 21 extending outward perpendicularly from the middle section 22 such that the drain tee connector stem 21 forms a 'T' connection with the drain body 61 wherein the tee connector stem 21 is fluidly connected with the drain body 61. The drain tee connector stem 21 includes a smooth section terminated by a castellated section containing at least two pawls 211. Each pawl 211 terminates with an outward protruding step 2112 and an inward facing ramped step 2111.

Figure 5:
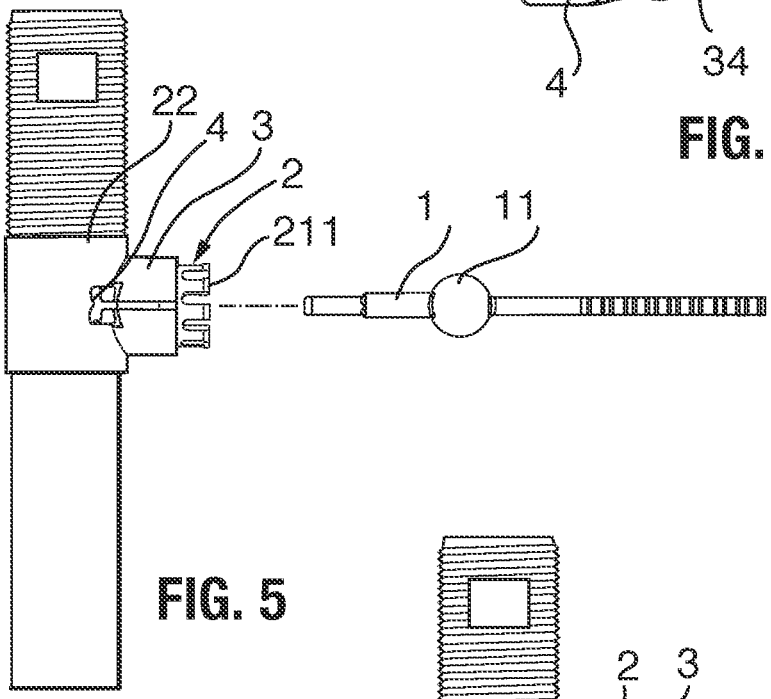
FIG. 5 is a front view of the drain body with the horizontal pivot rod about to be inserted into the receiver.
Figure 6:
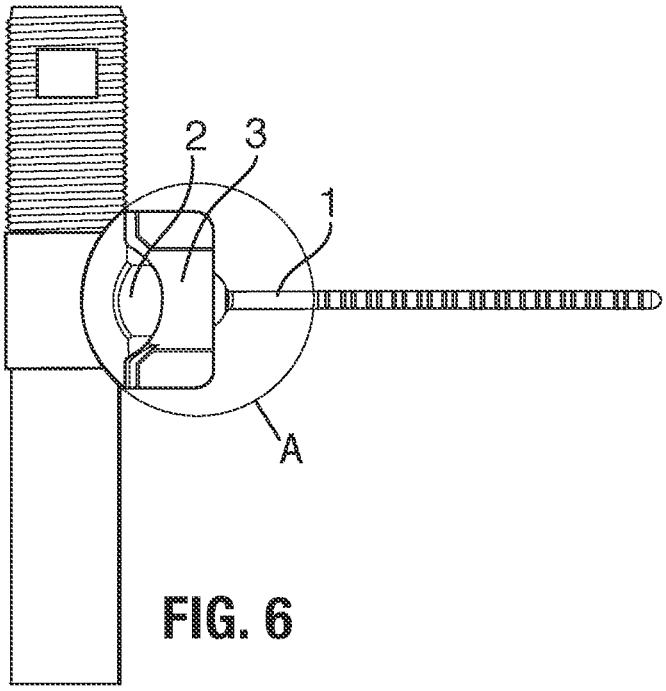
FIG. 6 is a front view of the drain body with the horizontal pivot rod ball inserted into the receiver and the manual locking ring in the locked position.
Figure 7:
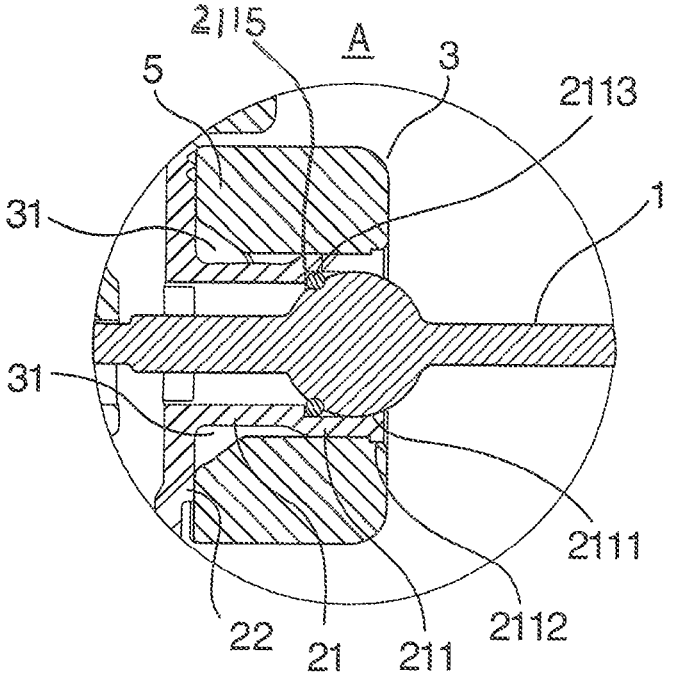
FIG. 7 (PRIOR ART)
FIG. 7 is an expanded cross-sectional view showing a conventional prior art drain tee connector stem having a round O-ring seated in an inner square annular forming a seal between the ball and the inner surface of the drain tee connector stem.
Figure 8:
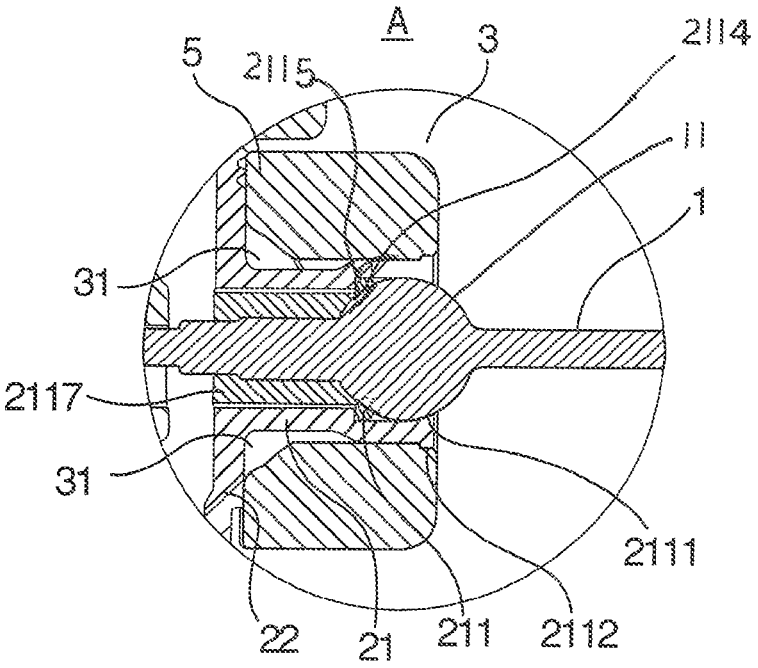
FIG. 8 is an expanded cross-sectional view of the present invention showing a drain tee connector stem having a resilient bowl type washer having a wedge shaped edge seated in an inner square annular forming a seal between the ball and the inner surface of the drain tee connector stem.
Figure 9A:
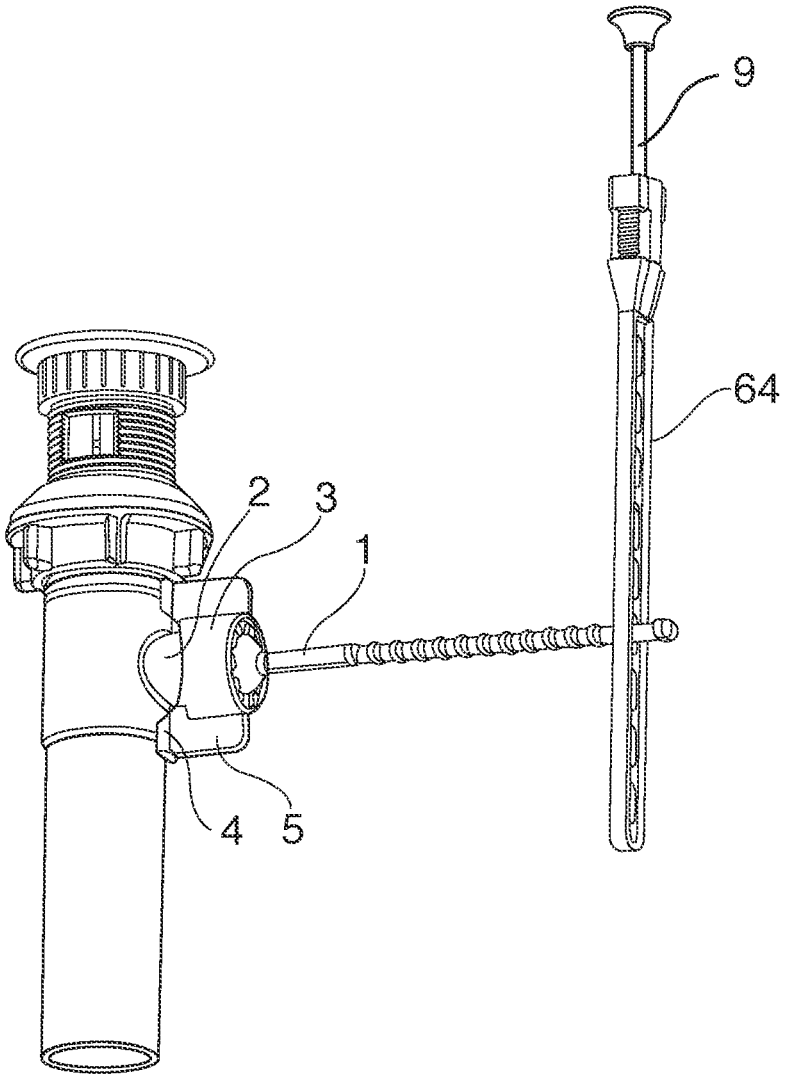
FIG. 9A is a perspective view of a pop-up assembly including the drain body the horizontal pivot rod and the lift rod and lock ring.
Figure 9B:
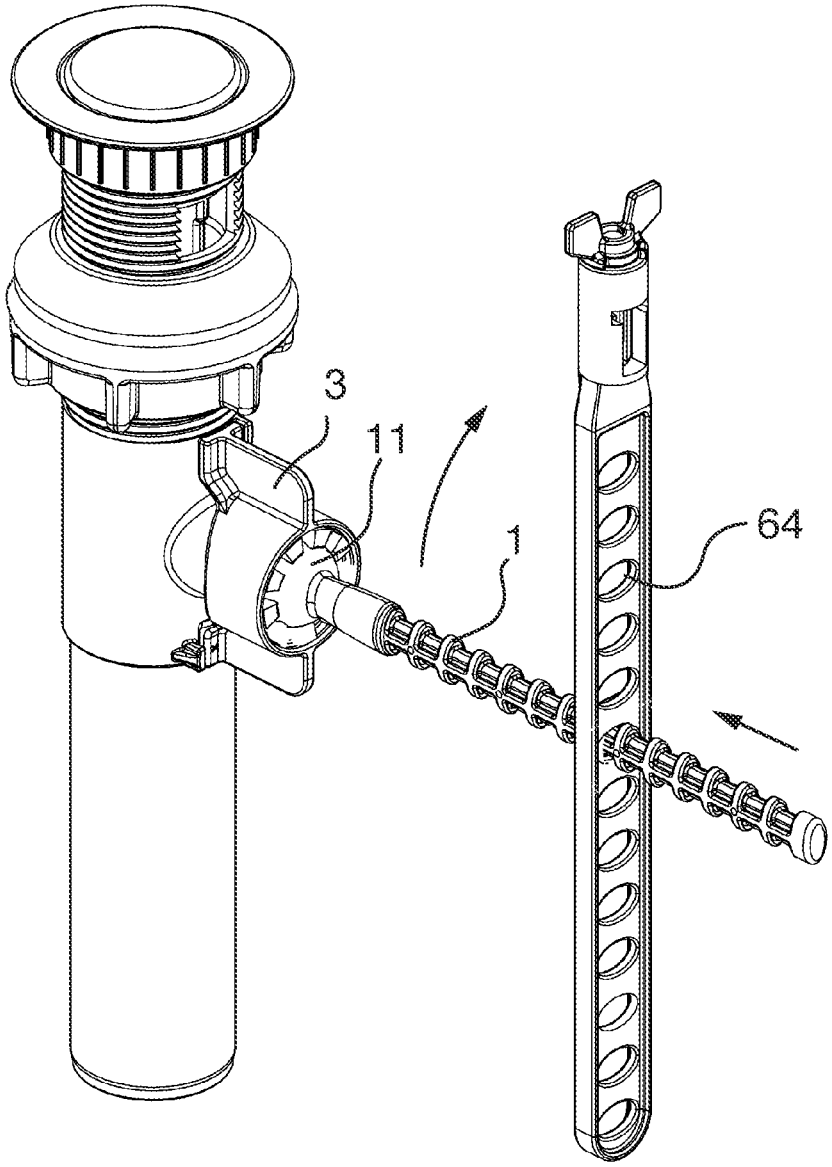
FIG. 9B is a perspective view of a pop-up assembly including the drain body the horizontal pivot rod and the lift rod and lock ring showing rotation of the pivot rod.
Figure 9C:
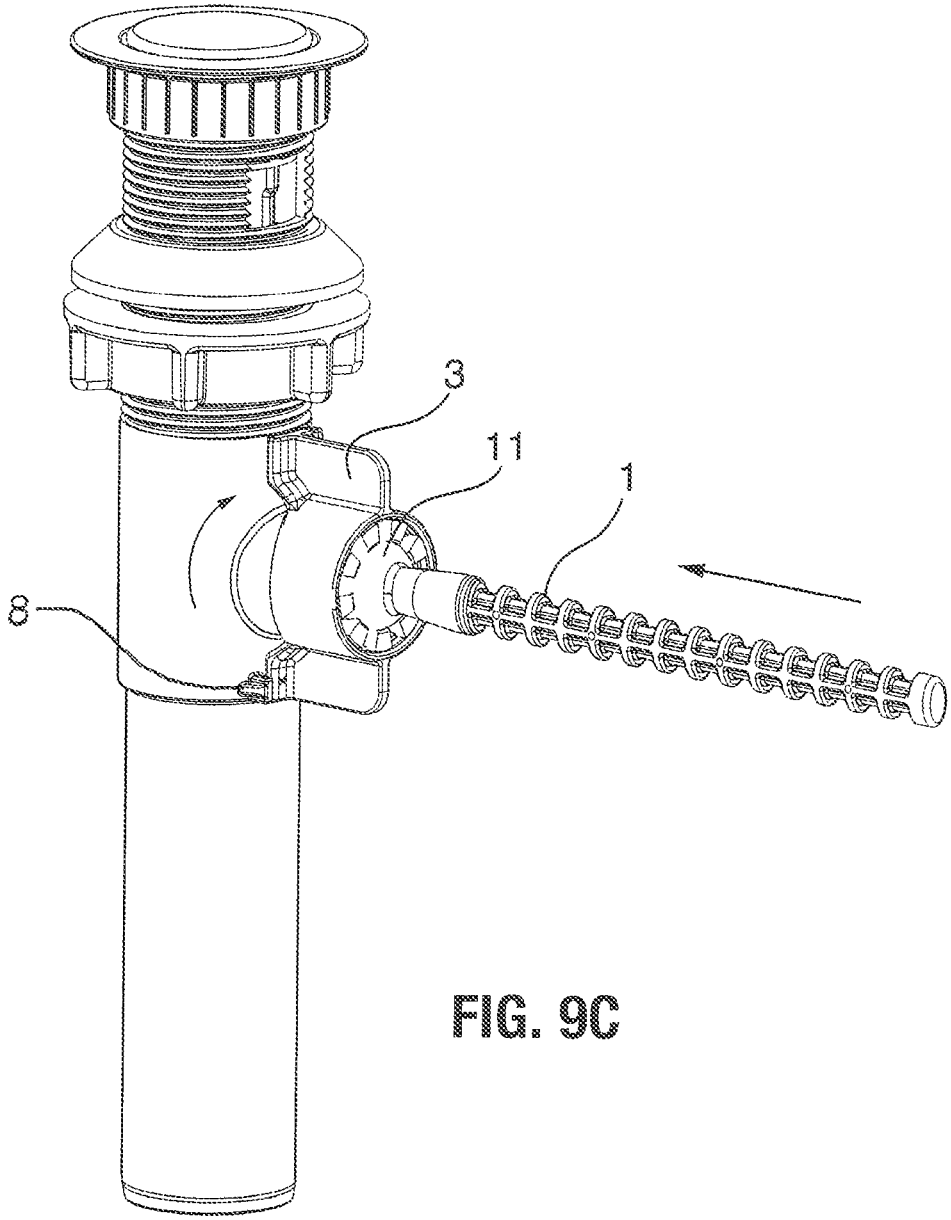
FIG. 9C is a perspective view of a pop-up assembly including the drain body the horizontal pivot rod and the lift rod and lock ring showing rotation of the pivot rod.

The horizontal pivot rod 1 includes an integral spherical ball 11 located about two inches from the left end. The drain plug 62 in FIG. 22 has an aperture 622 at the bottom end. With the drain plug inserted downward into the drain body 61, the aperture 622 is aligned with the drain tee connector stem 21. With reference to FIG. 5, the left end of the horizontal pivot rod 1 is pushed through the castellated section of the drain tee connector stem 21. The ball 11 of the horizontal pivot rod 1 is pushed through the pawls 211 and snaps past the inward facing ramped steps 2111 of the pawls 211 and into the drain tee connector stem 21.

In a conventional pop-up assembly, the drain tee connector stem 21 includes an inner square annular void into which is place a rubber or otherwise resilient O-ring 2113 forming a seal between the ball 11 and the inner surface of the shoulders of the stem receiving conduit for the drain tee connector stem 21. The present invention replaces the round O-ring 2113 with a bowl type of rubber seal composed of rubber, silicone, or other suitable polymer or elastomer for forming a water tight seal or other resilient material and optionally flairs the shoulder for cooperative engagement of the bowl type of seal. The bowl type seal 2114 requires less compression pressure for a solid sealing fit and rotates more smoothly than a conventional O-ring.

The drain tee connector stem 21 includes an inner square annular void forming a square ramp or shoulder 2115 into which is place a rubber or otherwise resilient bowl type washer 2114 forming a seal between the ball 11 and the inner surface of the drain tee connector stem 21. The curvature of the inward facing ramped step or shoulder 2114 as illustrated in FIGS. 11 and 15 corresponds to the curvature of the ball 11 and thus, the ball 11 is tightly held with the drain tee connector stem 21 by the pressure of the inward facing ramped steps 2111 of the pawls 211 against the ball 11. The resilient ring can be an O-ring is shown in the conventional prior art FIGS. 10 and 14, which utilizes a flat shoulder 2115 with the inner edge that contacts the ball 11 providing a smaller sealing surface as compared with the bowl shaped seal 2114 as shown best in FIGS. 11 and 15. The conventional O-ring 2113 is best shown in FIGS. 10 and 14.

Figure 10:
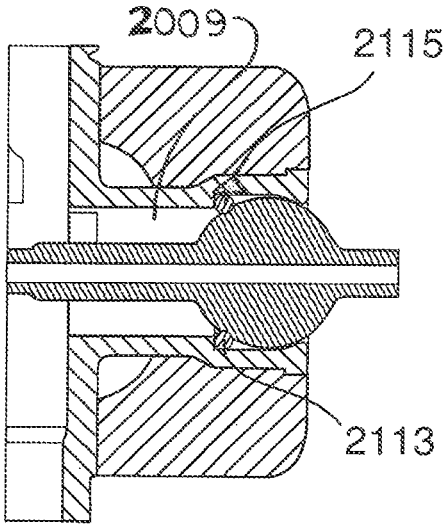
FIG. 10 ( PRIOR ART )
FIG. 10 is a right side view showing a conventional prior art receiver having an O-ring compressed between with the spherical ball inserted and the manual locking ring in the installed position and shows the stem requiring alignment extending into the ball receiving conduit.
Figure 11:
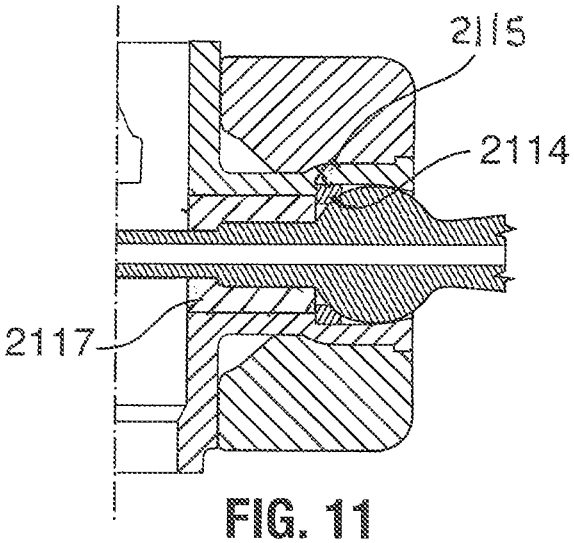
FIG. 11 is a right side view of FIG. 8 showing a drain tee connector stem receiver having a resilient bowl type washer compressed and wedged between the spherical ball and the manual locking ring in the installed position and showing the stem extending into the ball receiving conduit between alignment members wherein the wedge shaped washer reduces pressure and provides smoother ball surface rotation operation.
Figure 12:
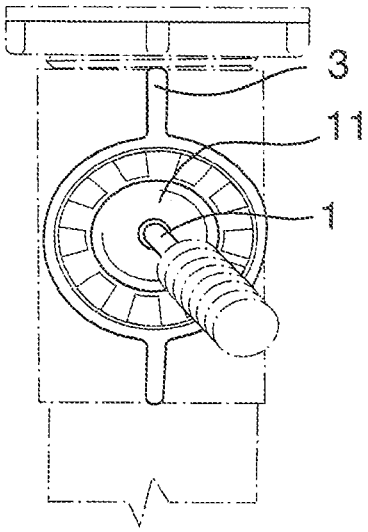
FIG. 12 is a side view of the receiver with the spherical ball inserted and the manual locking ring in the installed position of the receiver.
Figure 13:
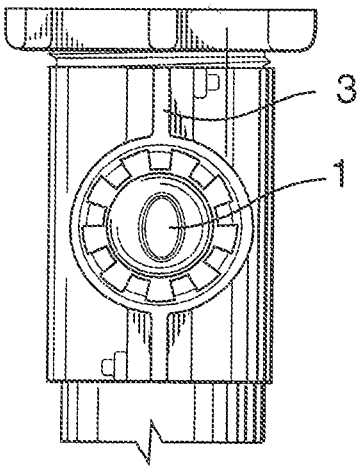
FIG. 13 is a right side view of the present drain body with the horizontal lever installed and the manual locking ring in position against two lugs extending outward from the drain body.
Figure 14:
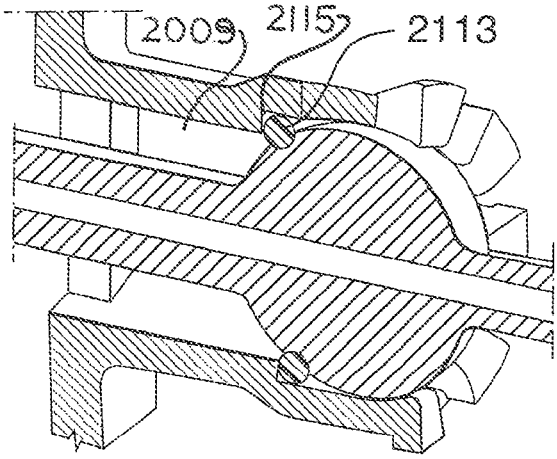
FIG. 14 ( PRIOR ART )
FIG. 14 is a cross-sectional view of the receiver area of the drain body and horizontal pivot rod taken vertically along the axis of the horizontal pivot rod of the conventional prior art device showing a void between the stem and receiver conduit requiring alignment of the stem.
Figure 15:
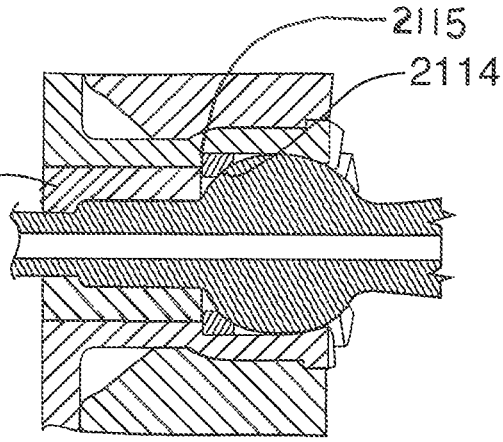
FIG. 15 is a cross-sectional view of the present invention receiver area of the drain body and horizontal pivot rod taken vertically along the axis of the horizontal pivot rod showing stem guide disposed in the receiver conduit for quick and accurate self alignment of the stem and ball.
Figure 16:
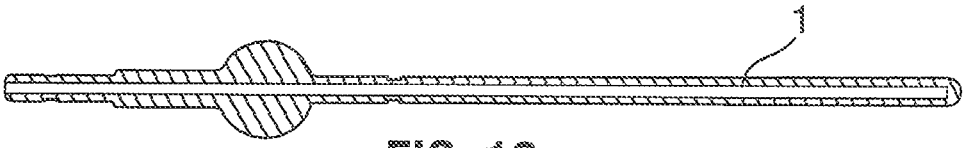
FIG. 16 is a side view of the pivot rod.
Figure 17:
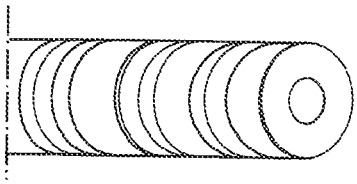
FIG. 17 ( PRIOR ART )
FIG. 17 shows a prior art pivot rod.
Figure 19:
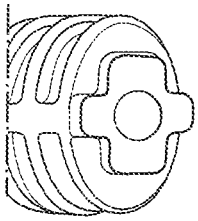
FIG. 19 is a right perspective end view of the horizontal pivot rod of FIG. 18 showing a thicker rod having a metal center and axial notches forming a corrugated body for improved lateral strength and rigidity.
Figure 18:
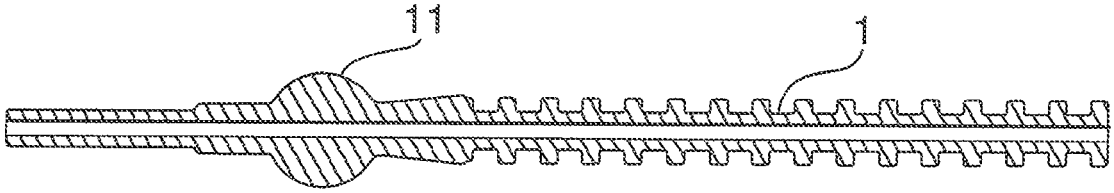
FIG. 18 is a top view of the horizontal pivot rod of the present invention having an inner metallic strengthening rod having a stepped down inner stem portion for cooperatively engaging alignment members within the stem receiving conduit and a proximate portion extending from the ball having a flared portion for a snug fit with the receiving conduit and larger lip for biasing against the locking ring.

Furthermore, as shown in FIGS. 10 and 14, the receiver area of the drain body and horizontal pivot rod taken vertically along the axis of the horizontal pivot rod of the conventional prior art device showing a void area 2009 between the stem and receiver conduit with no alignment of the stem. The instant invention as shown in FIGS. 11 and 15, the receiver area of the drain body and horizontal pivot rod extends along the axis of the horizontal pivot rod showing stem guide 2117 disposed in the receiver conduit and abutting the bowl shaped o-ring 2113 for quick and accurate self alignment of the stem and ball.

Figure 23:
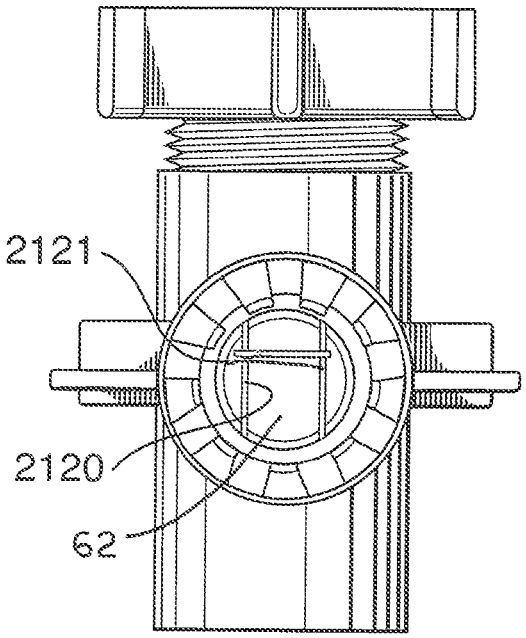
FIG. 23 is a side view of the drain plug assembly showing the bottom of the drain plug extending downward therein for cooperative engagement with the stem and showing the vertical inner rod guides.

Thus the drain tee connector stem 21 provides a pivot point for the horizontal pivot rod 1 as the right end of the rod is raised or lowered. The free end of the rod 1 should only be able to move up and down and not left or right, as a spherical ball would allow. Therefore, vertical guide walls 2120 and 2121 are parallel with one another and aligned coaxially with and integral with the drain tee connector stem 21. Vertical shoulders 110 of the rod 1 slide up and down inside the guide walls 2120 and 2121 as the free end of rod 1 is lowered and raised and, thus, left and right movement of the free end of horizontal pivot rod 1 is prevented as shown in FIG. 23.

Figure 4:
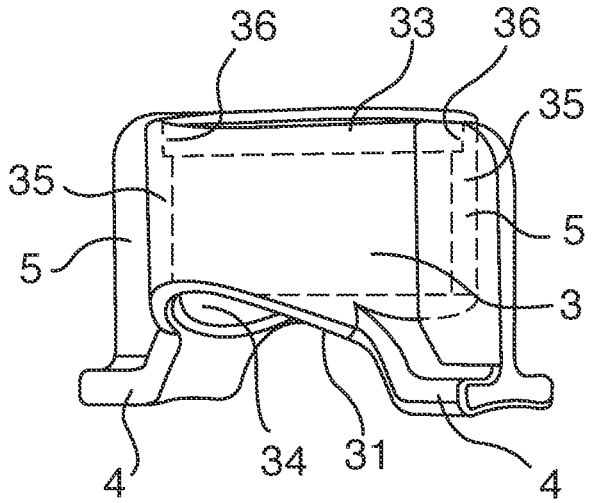
FIG. 4 is the front perspective view of the manual lock ring.

As illustrated in FIG. 4, the lock ring 3 comprises a hollow cylinder 33 with preferably two wings 5, similar to the wings on a wing retaining nut providing for manual turning of the lock ring 3 by pressing the thumb against one wing and the index finger against the other wing. The cylindrical portion of the lock ring 3 coaxially slides over the drain tee connector stem 21 and can be spun around the drain tee connector stem 21. The lock ring 3 also includes two downward extending lugs 4 connected at the bases of the two wings 5. The lugs 4 cooperatively press against the middle section 22 of the drain body 61 when the lock ring 3 is spun around the drain tee connector stem 21, thus urging the lock ring 3 radially away from the drain body conduit section 22. The cylinder 33 has an inner diameter equal to the outer diameter of a circle formed by the outer walls of the at least two pawls 211. The cylinder 33 includes a cylindrical void 36 which receives the pawl steps 2112 extending radially outwards from the free edges of the at least 2 pawls 211. As the lock ring 3 is turned or spun on the outside of the drain tee connector stem 21, the lugs 4 encounter the outside of the drain body 61, the lock ring is urged away from the drain body 61 and the inner walls of the lock ring squeeze the pawls 211 radially inward tightly against the ball 11. This prevents the ball 11 from escaping out of the drain tee connector stem 21. Further, the pawl steps 2112 are engaged against the outer walls formed by the cylindrical void 36, which limits the lock ring movement and prevents the lock ring 3 from sliding off of the drain tee connector stem 21. Stop lugs 8 which are integral with the drain body 61 provide a positive stop for locating the lock ring 3 in a position which causes the pawls 211 to apply holding pressure against the ball 11.

Figure 20:
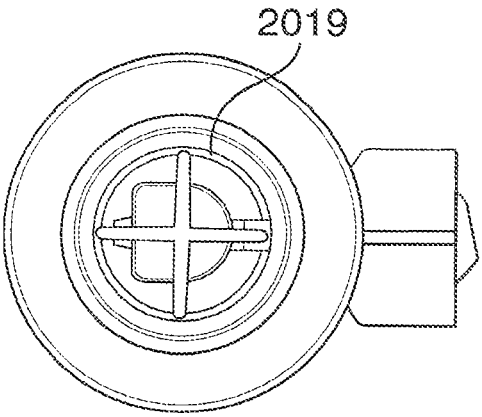
FIG. 20 ( PRIOR ART )
FIG. 20 is a top through-hole view through the drain body of a conventional prior art drain assembly showing the secured restrictor supporting the rod on an axial rim hole.
Figure 21:
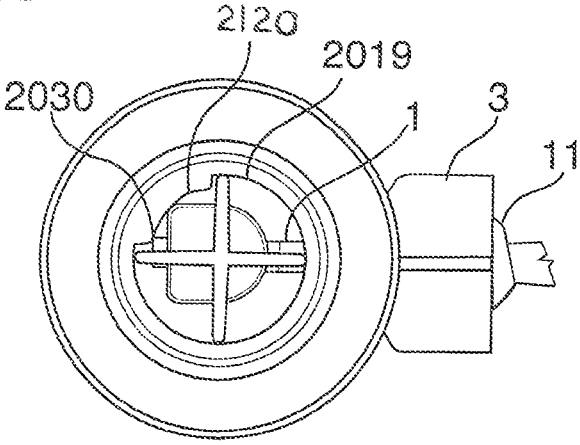
FIG. 21 is a top through-hole view of the drain body of the instant invention showing the arcuate plug alignment lug in the axial bore for aligning the distal end of the pivot rod.
Figure 22:
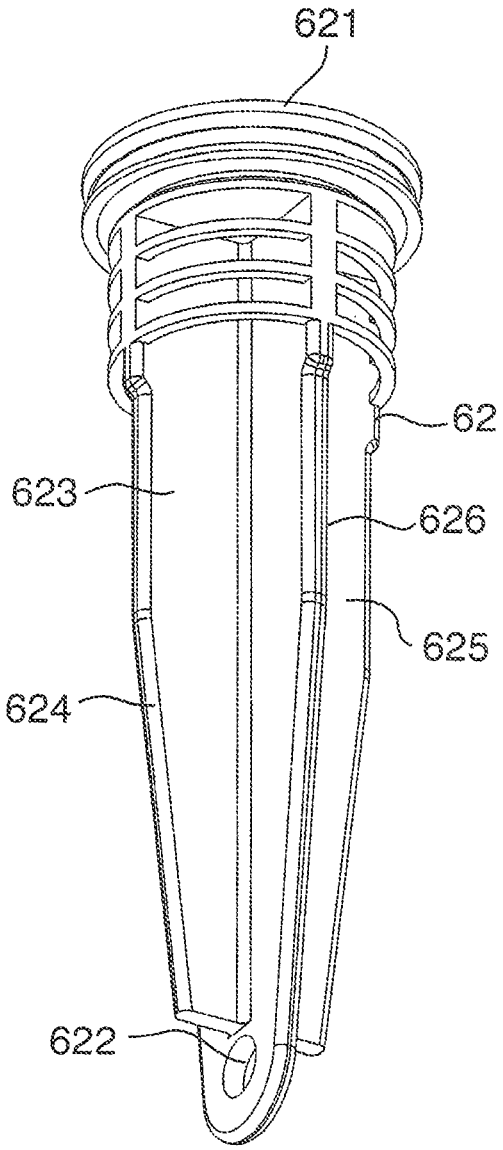
FIG. 22 is a perspective view of a drain stopper without the arcuate plug alignment lug.

FIG. 20 shows a conventional prior art through-hole view of the drain body inner side wall showing the axial bore for aligning the distal end of the pivot rod. FIG. 21 shows a through-hole view of the drain body of the instant invention showing the arcuate plug alignment lug 2120 formed in the axial bore of the inner side wall 2019 for aligning the distal end of the pivot rod for engaging the distal tip 2030 of the lift rod.

The drain plug 62 comprises a cap 621, a longitudinal body four longitudinal perpendicular walls 623, 624, 625 and 626, and a downward extending drain plug lug 622 having an aperture formed therein. The end of the horizontal pivot rod 1 which is inserted into the drain tee connector stem 21 is also inserted in the aperture of the plug lug 622. This allows the rod 1 to move the drain plug 62 up and down as the free end of the rod 1 is lowered or raised. The walls 623, 624, 625 and 626 together form a '+' sign or cross when viewed from either the top or the bottom of the plug.

The drain plug 62, without the cap 621, could be inserted into the drain body 61 at the time of assembly at any angle such that the end of the rod 1 may not be aligned with the aperture in the bottom end of the drain plug. The present invention includes an improved integral arcuate lug 7 extending radially inward, providing a guide to help insure that the drain plug is positioned properly in the drain body 61.

The pop-up drain assembly of the present invention is functionally similar to conventional bathroom sink drains; however, the assembly provided allows quick and easy installation as well as disassembly during normal maintenance tasks. Removal of the drain plug 62 is as simple as turning the lock ring 3 to 90 degrees and sliding the lock ring toward the drain body 61, pulling the horizontal pivot rod out and then pulling the drain plug up and out. Reassembly is just the reverse. Proper placement of the horizontal pivot rod and the drain plug is provided by the arcuate lug 7 and the guide walls 2120 and 2121, respectively.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

We claim:

1. A pop-up drain assembly comprising:

a drain body, a drain plug, a horizontal pivot rod, a lock ring, and a lift rod rotatably connected to an outer free end of said horizontal pivot rod;

said drain body being generally cylindrical and comprising a lower unthreaded section, an upper threaded section and a middle unthreaded section with a drain tee connector stem extending outward perpendicularly from said middle section;

said drain tee connector stem including a smooth section terminated by a castellated section containing at least two pawls, each of said at least two pawls including a radially outward protruding step and an inward facing ramped step;

said horizontal pivot rod including an integral spherical ball located a selected length from a first end, said drain plug having an aperture formed therein at a bottom end, said drain plug inserted downward into said drain body, said aperture in said drain plug end aligned with said drain tee connector stem;

said first end of said horizontal pivot rod pushed through said castellated section of said drain tee connector stem, said ball of said horizontal pivot rod pushed through said pawls and snapped into said drain tee connector stem;

said drain tee connector stem having an inner square annular void formed therein capable of receiving a flat ring seal;

a curvature of said inward facing ramped steps matches a curvature of said ball;

said drain tee connector stem having inner vertical guide walls, said horizontal pivot rod having square vertical shoulders cooperatively and slidably engaging said inner vertical guide walls;

said lock ring comprising a hollow cylinder with a pair of wings extending radially outward from outer walls of said lock ring and having downward extending lugs integral to bases of said pair of wings, said downward extending lugs cooperatively pressing against said drain body when said lock ring is tightened, said lock ring having an inner diameter equal to an outer diameter of a circle formed by said outer walls of said at least two pawls, said lock ring having a cylindrical void formed in an outer end thereof for receiving said pawl steps extending radially outward from a free edges of said at least two pawls, said drain body having stop lugs extending radially outward therefrom providing a positive stop to locate said lock ring in a position causing said pawls to apply holding pressure against said ball;

said drain plug comprising a cap, a longitudinal body with longitudinal perpendicular walls and a downward extending drain plug lug having an aperture formed therein;

said first end of said horizontal pivot rod inserting into said drain tee connector stem and into said aperture of said plug lug, and said longitudinal perpendicular walls together forming a cross; and said drain body having an integral arcuate lug extending radially inward providing a guide cooperatively engaging of said longitudinal perpendicular walls of said cross insuring that said drain plug is positioned properly in said drain body.

2. The pop-up drain assembly of claim 1, wherein said stop lugs and said wall guides align said lift rod and said pivot rod and for insertion of said ball in a correct position quickly and accurately.

3. The pop-up drain assembly of claim 1, wherein said flat ring held between the drain body and the spherical ball includes a cambered inner edge contacting said ball providing an enlarged sealing surface to provide a leak-proof connection.

4. The pop-up drain assembly of claim 1, wherein said pop-up drain plug provides alignment of a hole at the bottom end of said pop-up drain plug with an end of said horizontal pivot rod wherein an arcuate plug alignment lug extends inwardly from an inside wall of said poop-up drain body.

5. The pop-up drain assembly of claim 1, said drain body including at least one outward extending lug providing a positive stop and a mark for registering said locking ring with said drain body in a position providing for maximum locking force between said receiver and said spherical ball.

6. The pop-up drain assembly of claim 1, wherein said stem guide is disposed in said receiver conduit for quick and accurate self alignment of said stem guide and said ball.

7. The pop-up drain assembly of claim 1, wherein uses an enlarged metal insert to improve the strength of said pivot rod minimizing flexing of said pivot rod.

8. A pop-up drain assembly comprising:

a drain body, a drain plug, a horizontal pivot rod, a lock ring, and a lift rod rotatably connected to an outer free end of said horizontal pivot rod;

said drain body being generally cylindrical and comprising a lower section, an upper section and a middle section with a drain tee connector stem extending outward perpendicularly from said middle section;

said drain tee connector stem including a smooth section terminated by a castellated section containing at least two pawls, each of said at least two pawls including an inward facing step;

said horizontal pivot rod including an integral spherical ball located a selected length from a first end, said drain plug having an aperture formed therein at a bottom end, said drain plug inserted downward into said drain body, said aperture in said drain plug end aligned with said drain tee connector stem;

said first end of said horizontal pivot rod pushed through said castellated section of said drain tee connector stem, said ball of said horizontal pivot rod pushed through said pawls and snapped into said drain tee connector stem;

said drain tee connector stem having an inner annular void formed therein capable of receiving a ring seal;

said drain tee connector stem having inner vertical guide walls, said horizontal pivot rod having shoulders cooperatively and slidably engaging said inner vertical guide walls;

said lock ring comprising a hollow cylinder with means for holding extending radially outward from outer walls of said lock ring and having downward extending lugs integral to bases of said means for holding, said downward extending lugs cooperatively pressing against said drain body when said lock ring is tightened, said lock ring having an inner diameter equal to an outer diameter of a circle formed by said outer walls of said at least two pawls, said lock ring having a cylindrical void formed in an outer end thereof for receiving said pawl extending radially outward from a free edge of said at least two pawls, said drain body having stop lugs extending radially outward therefrom providing a positive stop to locate said lock ring in a position causing said pawls to apply holding pressure against said ball;

said drain plug comprising a cap, a longitudinal body with longitudinal perpendicular walls and a downward extending drain plug lug having an aperture formed therein;

said first end of said horizontal pivot rod inserting into said drain tee connector stem and into said aperture of said plug lug, and said longitudinal perpendicular walls together forming a cross; and said drain body having an integral arcuate lug extending radially inward providing a guide cooperatively engaging said longitudinal perpendicular walls of said cross insuring that said drain plug is positioned properly in said drain body.

9. The pop-up drain assembly of claim 8 wherein said ring seal is a flat ring seal.

10. The pop-up drain assembly of claim 9, wherein said drain tee connector stem includes an inner square annular void formed therein for receiving said flat ring seal.

11. The pop-up drain assembly of claim 8, wherein a curvature of said inward facing ramped steps matches a curvature of said ball.

12. The pop-up drain assembly of claim 8, said drain body comprising a lower unthreaded section, an upper threaded section and a middle unthreaded section.

13. The pop-up drain assembly of claim 8, wherein said stop lugs and said wall guides align said lift rod and said pivot rod and for insertion of said ball in a correct position quickly and accurately.

14. The pop-up drain assembly of claim 8, wherein said flat ring held between the drain body and the spherical ball includes a cambered inner edge contacting said ball providing an enlarged sealing surface to provide a leak-proof connection.

15. The pop-up drain assembly of claim 8, wherein said pop-up drain plug provides alignment of a hole at the bottom end of said pop-up drain plug with an end of said horizontal pivot rod wherein an arcuate plug alignment lug extends inwardly from an inside wall of said poop-up drain body.

16. The pop-up drain assembly of claim 8, said drain body including at least one outward extending lug providing a positive stop and a mark for registering said locking ring with said drain body in a position providing for maximum locking force between said receiver and said spherical ball.

17. The pop-up drain assembly of claim 8, wherein said stem guide is disposed in said receiver conduit for quick and accurate self alignment of said stem guide and said ball.

18. The pop-up drain assembly of claim 8, wherein uses an enlarged metal insert to improve the strength of said pivot rod minimizing flexing of said pivot rod.

19. The pop-up drain assembly of claim 8, wherein said means for holding comprises at least one pair of wings extending radially therefrom.

20. The pop-up drain assembly of claim 8, wherein said the pawl steps engage against said outer walls formed by said cylindrical void limiting said lock ring movement preventing said lock ring from sliding off of said drain tee connector stem.

* * * * *